United States Patent [19]

Dunn et al.

[11] 4,397,028

[45] Aug. 2, 1983

[54] ELECTRODE SUPPORT MECHANISM

[75] Inventors: Charles S. Dunn, Pataskala; Stephen Seng, Bladensburg; Michael D. Hickman, Ravenna, all of Ohio

[73] Assignee: Owens-Corning Fiberglas Corporation, Toledo, Ohio

[21] Appl. No.: 342,855

[22] Filed: Jan. 26, 1982

[51] Int. Cl.[3] ..... H05B 7/109

[52] U.S. Cl. ..... 373/94; 373/99; 373/100; 373/52; 373/105

[58] Field of Search ..... 373/50–53, 373/94, 98, 99, 100, 101, 105, 106

[56] References Cited

U.S. PATENT DOCUMENTS

| | | | |
|---|---|---|---|
| 2,494,775 | 1/1950 | Moore . | |
| 2,623,080 | 12/1952 | Young . | |
| 2,942,044 | 6/1960 | Lyman . | |
| 3,072,732 | 1/1963 | Maloney . | |
| 3,689,680 | 9/1972 | Reimpel et al. | 373/52 |
| 3,752,896 | 8/1973 | Zimmermann et al. | 373/51 |
| 3,823,243 | 7/1974 | Vitale . | |
| 3,898,364 | 8/1975 | Hardin . | |
| 4,154,973 | 5/1979 | Paton et al. . | |

FOREIGN PATENT DOCUMENTS

| | | |
|---|---|---|
| 898528 | 6/1962 | United Kingdom . |
| 1031355 | 6/1966 | United Kingdom . |

*Primary Examiner*—Roy N. Envall, Jr.
*Attorney, Agent, or Firm*—Ronald C. Hudgens; Patrick P. Pacella

[57] ABSTRACT

An electrode support mechanism for use in electric arc melting or smelting furnaces wherein a pair of horizontal, superimposed arms are each provided with clamping devices at their outer end for supporting a vertically disposed electrode depending into an arc furnace. The arms are each supported on a vertical support post; the upper arm is fixed to the post and the lower arm which normally carries the electrode is movable relative to the post to adjust the electrode to maintain a constant arc at the furnace. The movable arm is moved vertically by a jack screw carried by the upper arm and depending into contact with the lower arm. The clamping devices at the ends of the arms are spring-biased toward contact with the electrode, and a linking mechanism is provided to alternately release the arm clamping mechanisms from the electrode under the control of a cam-operated actuating system. The electrode is clamped to the lower clamping arm when the lower clamping arm is operating within its normal range of adjustment, but the electrode is released from the lower arm and clamped to the upper clamping arm whenever it is necessary to move the lower arm independently of the electrode to reposition the lower clamping arm within its normal range of adjustment.

5 Claims, 4 Drawing Figures

ELECTRODE SUPPORT MECHANISM

TECHNICAL FIELD

In the utilization of arc melting furnaces for the melting of basalt, glass batch, metals or the like, or for ore reduction, the charge to be melted is introduced in pulverant form into a furnace or crucible having a plurality of top-entering, vertically suspended electrodes. The electrodes typically are pre-baked, cylindrical carbon sections which are screwed together and which are consumed during the melting process.

The electrical current is supplied to the electrodes, typically three in number, from a transformer as the electrodes are individually suspended in the furnace or crucible for independent vertical displacement. The electrodes are individually adjusted vertically to maintain a constant voltage at each electrode-batch interface location, and the amperage varies as the resistance in the furnace changes.

The electrodes must be raised and lowered independently of one another with varying furnace operating conditions, e.g., as the resistance of the arc changes upon variations in the molten material level and the molten material temperature, as the electrode is consumed, and as cooler incoming raw materials are fed into the furnace. As a result, the electrodes are frequently moved up and down as they individually hunt for the desired balance point. Prior to the present invention, various forms of electrode supports have been proposed, but such supports have been cumbersome, expensive, non-positive electrode feeding means, which, for example, do not positively support the electrode independently of the electrode adjusting mechanism as the adjusting mechanism is reset due to electrode consumption.

DISCLOSURE OF THE INVENTION

The present invention now provides a new and novel electrode support mechanism for use in electric arc melting or smelting furnaces.

Generally, the present invention proposes the utilization of two, parallel support arms for each electrode, the arms being cantilevered from a common vertical support parallel to the electrode. Each of the arms is provided with an electrode clamping mechanism, with the electrode at all times being clampingly engaged by at least one of the arms.

The lower of the arms is vertically adjustable relative to the furnace to move the electrode vertically and to support the electrode as it individually hunts for its proper balance point to maintain a constant voltage at the furnace location. The upper of the arms is fixed to the support post and its clamping mechanism is normally disengaged from the electrode as it is supported for movement on the lower arm.

Periodically, it is necessary to reposition the lower arm on the electrode, due primarily to electrode consumption. At this time, the clamping means of the upper arm is engaged with the electrode, the lower arm is unclamped from the electrode, the lower arm is elevated to a position within its normal range of movement, and the lower arm is reclamped to the electrode, after which the upper arm clamping means is opened to release the electrode therefrom.

The lower arm is vertically moved by means of a vertical adjustment screw rotatably carried by the upper arm and depending downwardly for engagement with the lower arm.

The clamping means for the two arms are constantly spring biased toward electrode engagement and individual cams, driven by a common shaft, are utilized to alternately engage the clamping means of the two arms with the electrode.

BEST MODE OF CARRYING OUT THE INVENTION

Figure 1:
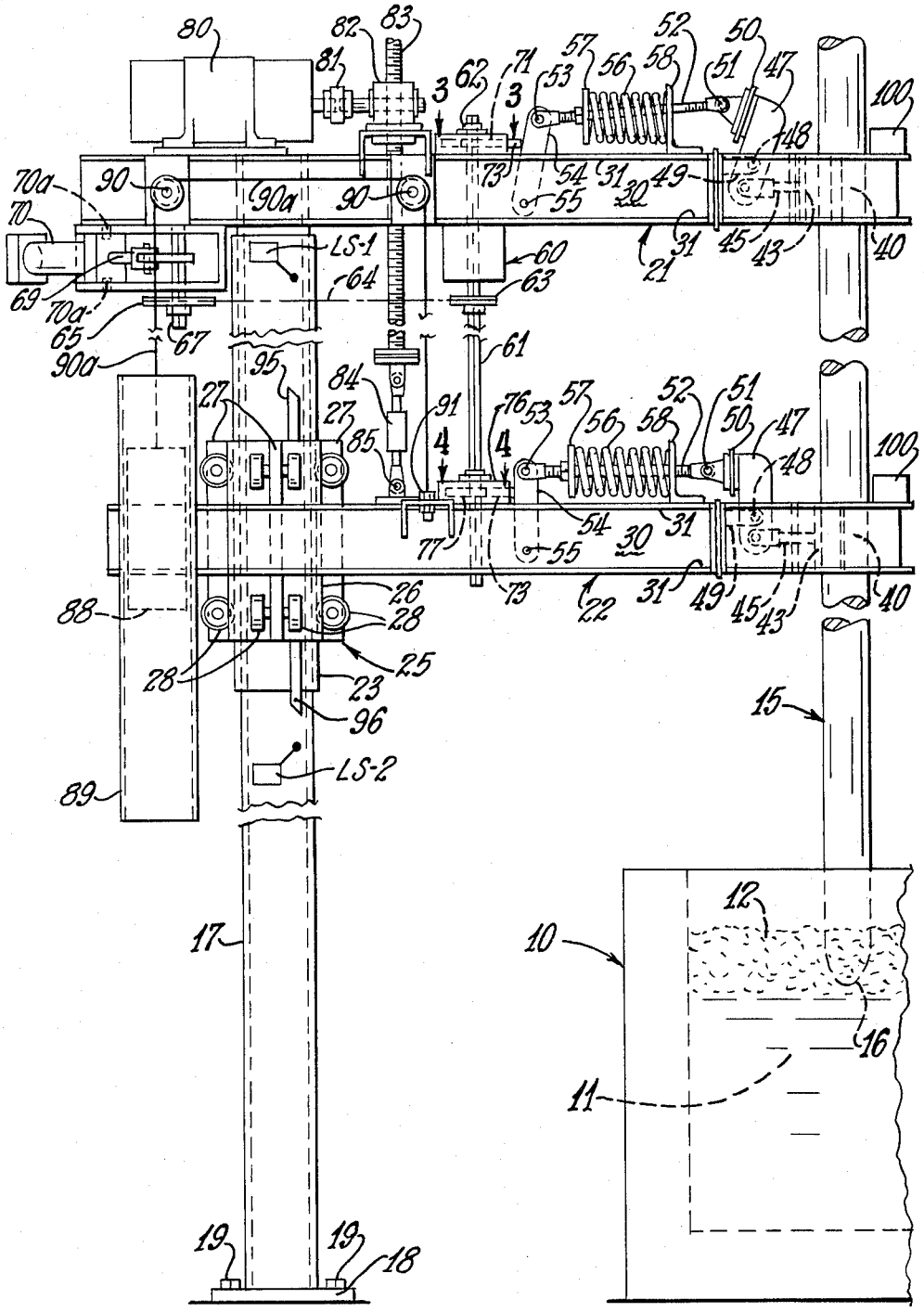
FIG. 1 is a side elevational view of an electrode carrying mechanism of the present invention.

As best shown in FIG. 1, the mechanism of the present invention is intended to be utilized in conjunction with an arc melting furnace indicated by reference numeral 10 enclosing a body of molten material 11 surmounted by a batch blanket 12 of pulverant raw material. The molten material of the body 11 may be molten basalt, molten glass, molten metal or any other molten material surmounted by the blanket 12 of raw, unmelted material. Superimposed over the furnace 10 is an electrode 15 having its lower end 16 extending into the furnace 10 and terminating within the batch blanket 12 above the level of the molten material 11. The electrode 10 preferably is of the consumable type and typically may comprise a cylindrical rod of pre-baked carbon, and preferably comprises a plurality of sections interconnected by suitable means, as by the conventional screw threads.

Positioned adjacent the furnace 10 is a vertical, upstanding post 17 secured, as by a mounting collar 18 and bolts 19 to a supporting surface to lie parallel to the vertical electrode 15. Secured to the upper extremity of the post 17 is an upper, horizontal supporting arm structure 21 fixed by appropriate means (not shown) to the post 17. Located beneath the arm 21 and in true vertical alignment therewith is a horizontal, lower arm structure 22 which is supported for movement relative to the post 17.

The support structure for the lower arm 22 includes a fixed support collar 23 enveloping the upper portion of the post to provide a guide for a lower arm carriage indicated generally at 25. This lower arm carriage 25 includes a central, open-ended sleeve 26 of a cross-section conforming to and closely embracing the fixed collar 23 and having a plurality of vertical ribs 27. Each rib 27 supports vertically spaced pairs of rollers 28 having their peripheries projecting through slots formed in the sleeve 26 and contacting the inner collar 23 in rolling contact therewith. It will be appreciated that the wheels 28 support the sleeve 26 for telescopic vertical movement upon the post collar 23 and the lower arm 22 is welded or otherwise rigidly secured to the sleeve 26 for vertical movement therewith.

Figure 2:
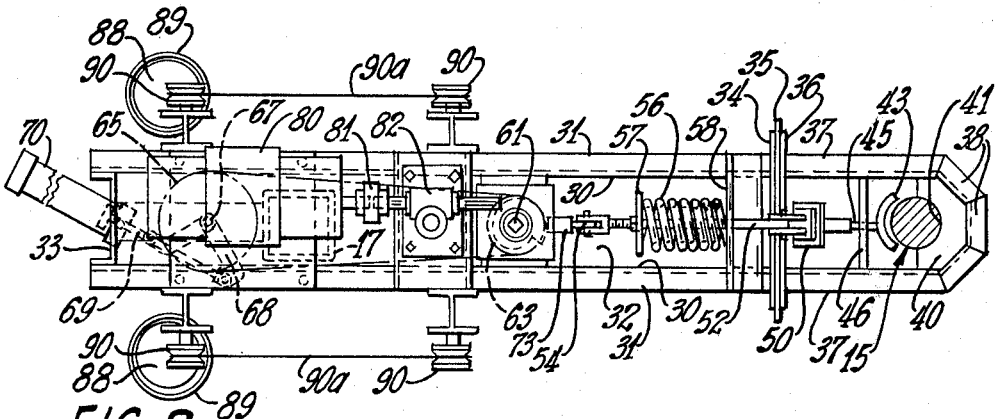
FIG. 2 is a plan view of the mechanism of FIG. 1.

The arms 21, 22 are of identical construction, and each is fabricated from two pieces of channel stock 30 having upper and lower outwardly directed flanges 31, the channels being spaced from one another to define an interior space 32 therebetween, as shown in FIG. 2. The channels 30 are retained in parallelism by appropriate cross members 33 and terminate at their forward ends in a vertical plate 34 which is laminated through a sheet of electrical insulating material to a flange 36 integral with a second pair of channels 37 similar to the channels 34 which are cut and welded to form a convex nose 38 at the free end of the arm.

Welded internally of the nose 38 to project into the open center space 32 of the arm is an electrode clamping pad 40 having a vertically extending, semi-cylindrical recess 41 therein for mating, sliding engagement with the electrode 15. Positioned on each clamping pad 40 is a power supply bracket 100 to which a power supply cable is attached to supply power to the electrode 15 in electrical contact therewith. A mating, arcuate, essentially semi-cylindrical movable electrode clamping element 43 is carried by an actuating stem 45 journaled in a guide plate 46 spanning the channel members 37, and this actuating stem 45 is pivotally secured to the lower end of an actuating lever 47. The actuating lever 47 is pivotally mounted by pin 48 to a bracket 48 carried by the flange 36, so that the lever 47 pivots in a vertical plane.

The free upper end of the lever 47 is connected, through an insulating assembly 50 similar to the assembly 34-36, to the free end 51 of an actuating rod 52 extending in a generally horizontal plane for attachment through pivot pin 53 to the upper end of an actuating link 54 pivoted at its lower end, as at 55, intermediate the side channels 30. A compression spring 56 is confined between a plate 57 secured to the rod 52 and a fixed bracket 58 surmounting the channels 30. The compression spring 56 normally biases the plate 57 to the left to rotate the lever 57 in a counterclockwise direction, thereby clampingly confining the electrode 15 between the arcuate clamping plate 43 and the fixed clamping pad 40.

As above explained, each of the arms 21, 22 is provided with the identical actuating mechanism including the pad 40, the clamping member 43 and the actuating mechanism 45, 47, 52, 54 and 56.

To actuate the above described linkage, a cam mechanism indicated generally at 60 is utilized. This cam mechanism 60 includes a shaft 61, preferably of rectangular or other polygonal cross-sectional configuration which is journaled at its upper end in a bearing 62 for rotation about a vertical axis. Positioned medially of the shaft is a sprocket 63 about which is trained an actuating chain 64, the chain is trained about a second sprocket 65 secured to a vertical drive shaft 67 carrying a crank arm 68. The crank arm 68 is pivotally connected to the actuating rod 69 of a cylinder 70 mounted on trunnions **70*a* underneath the arm 21. Actuation of the cylinder 70 to extend the arm 69 will actuate the crank arm 68 to turn the shaft 67 in a counterclockwise direction, which motion will be transmitted by the chain 64 to the sprocket 65 and the shaft 61. Retraction of the actuating rod 69 will move the two shafts 65 and 61 in their reverse or clockwise directions. It will be noted that the sprocket 65 is appreciably larger than the sprocket 63, so that the shaft 61 is arcuately displaced by the chain 64 to a greater extent than the sprocket 65 is arcuately displaced by the crank arm 68**.

Figure 3:
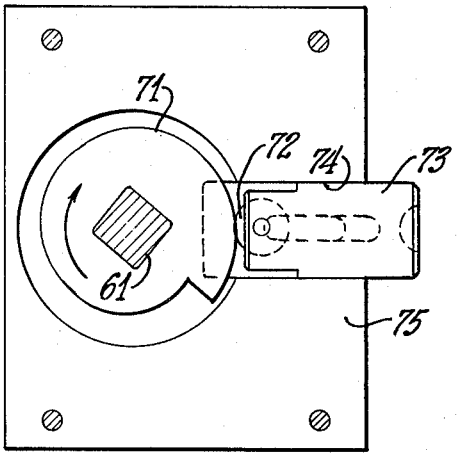
FIG. 3 is an enlarged sectional view taken along the plane 3—3 of FIG. 1.

Mounted upon the shaft 61 at its upper extremity is a first cam 71 best illustrated in FIG. 3 of the drawings. Cam 71 has its periphery in contact with a roller 72 forming a part of a cam follower 73 which is guided in a slot 74 formed in housing 75. When the cam 71 is arcuately displaced as viewed in FIG. 3, the cam follower 73 is extended beyond the housing 75, and the extended follower 73 is in contact with the link 54 to displace the link 54 in a clockwise direction to the position illustrated in FIG. 1. The clockwise movement of the link 54 compresses the spring 56 as it displaces the link 52 to the right, thereby pivoting the lever 47 in a clockwise direction to retract the electrode-engaging element 43 to its position illustrated in FIGS. 1 and 2.

Figure 4:
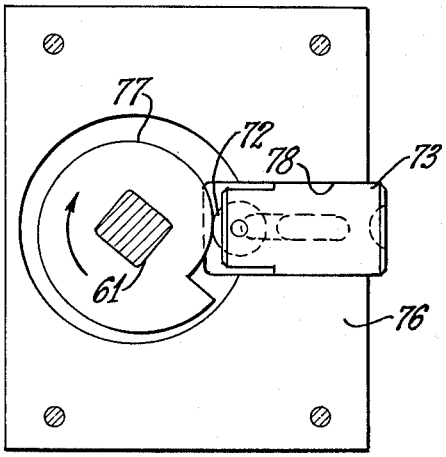
FIG. 4 is a sectional view taken on the plane 4—4 of FIG. 1.

The lower end of the shaft 61 projects into and through a lower housing 76 and a lower cam 77 confined therein, the shaft 61 projecting through housing 76 and the cam 77 with a sliding fit to accommodate relative vertical movement between the shaft 61 and the cam 77 which is confined by the housing 76 to be movable vertically with the lower arm 22. The lower cam 77 is provided with a cam follower 72 and slide 73 arrangement as explained in connection with the cam 71 of FIG. 3, all as shown in FIG. 4 of the drawings, and the housing 71 is provided with a slot 78 to receive the slide 73. The slide 78 contacts the link 54 of the lower arm to actuate the linkage exactly as described in connection with the linkage of the arm 21.

However, it will be noted that the cams 71, 77 are reversed on the shaft 61. In this way, the arcuate displacement of the shaft 61 in the counterclockwise direction as indicated in FIGS. 3 and 4 will turn the upper cam to displace the upper clamping element 43 of the upper arm 21 into contact with the electrode 15, while simultaneously the lower cam 77 is turned counterclockwise to push the lever 54 clockwise against the bias of the lower spring 56 to pull the lower clamping element 43 from clamping contact with the electrode 15. Upon arcuate displacement of the shaft 61 in a clockwise direction (opposite to the arrows of FIGS. 3 and 4), the reverse operation occurs, the lower clamp is engaged and the electrode 15 is released from the upper clamping element 43 as shown in FIG. 1. Further, the arcuate contour of the cams 71, 77 and the geometry of the linkage between the cams and the associated clamping elements is such that the operations overlap and the one cam (e.g., the lower cam 77) does not affect release of the associated clamping element 43 until the electrode has been finely clamped by the upper clamping element 43.

Thus, the electrode is firmly held at all times by one or the other of the arms 21, 22.

The arm 22 is elevated and lowered by power means including a reversible drive motor 80 mounted on the upper arm 21 and having its drive shaft coupled, as at 81, to a right angle drive mechanism indicated generally at 82 which is effective to actuate a threaded vertical actuating shaft 83 upwardly or downwardly relative to the upper arm 21. The lower end of the actuating shaft 83 is connected through a joint 84 to the lower arm 22, as at 85. The drive mechanism, i.e., the motor 80, drive mechanism 82, shaft 83, constitute a screw jack mechanism for vertically displacing the lower arm 22 relative to the upper arm 21. A counterweight 88 confined within a cylindrical guide 89 is provided on either side of the lower arm 22, the counterweight being carried by a cable or other tension means **90*a* trained about sheaves 90 fixed to the upper arm and secured as at 91 to the lower arm 22 to counterbalance the weight of the arm 22 and the electrode 15** carried thereby.

In operation of the mechanism, as best illustrated in FIGS. 1 and 2, the electrode 15 is adjusted vertically to maintain a substantially constant arc at its lower end by vertical movement of the arm 22, the electrode being firmly clamped to the arm by the clamping element 43 biased against the electrode 15 by the lower arm actuating spring 56. The movement of the arm 22 is controlled by conventional arc control means which form no part of the present invention and which drive the reversible drive motor 80 in the appropriate direction to either raise or lower the arm 22. The motor 80 through the right angle drive mechanism 82 raises or lowers the arm through the threaded vertical actuating shaft 83, with the counterweights 88 counterbalancing the weight of the arm and the electrode 15, so that the arm can move smoothly through its vertical path guided by the wheels or rollers 28 contacting the post sleeve 23. Thus, the arm 22 will move upwardly or downwardly to maintain a constant arc despite all of the variations of the process which may affect the arc, such as the rate of feed to compensate for electrode consumption, the level of the molten pool 11, the depth of the batch blanket 12, etc., so long as the arm 22 moves within its normal movement range.

Mounted at the upper extremity of the carriage 25 is an upstanding limit switch probe 95 which contacts the actuating blade of a limit switch LS-1 when the arm 22 is raised to the upper limit of its normal operating range. A similar, depending limit switch actuating blade 96 depends from the carriage 25 to contact the actuating blade of a limit switch LS-2 to indicate that the arm 22 has reached the lower limit of its normal operating range.

Assuming that electrode 15 is being normally consumed and that the electrode 15 has been progressively lowered by the arm 22 to compensate for such consumption, the arm 22 will be lowered to an extent such that the limit switch LS-2 is actuated by the probe 96. At this time, it is necessary that the arm 22 be reset to the upper limit of its normal operating range, and the actuated LS-2 emits a signal to indicate that this is required. As a result of the actuation of the limit switch LS-2, the cylinder 70 is actuated to retract the cylinder rod 69, thereby turning the sprockets 65, 63 in a clockwise direction and turning the shaft 61 in the same clockwise manner as indicated by the directional arrows in FIGS. 3 and 4. As a result, the upper cam 71 and the lower cam 77 are both displaced in a clockwise direction to reverse their positions as illustrated in FIGS. 3 and 4 to retract the lower clamping element 43 (thereby releasing the electrode from the lower arm) and advancing the upper clamping element 43 (thereby clamping the electrode to the upper arm).

Once the lower arm 22 releases the electrode 15, the motor 80 is actuated to fully retract the arm 22 upwardly until such time as the probe 95 actuates the limit switch LS-1. Upon actuation of the limit switch LS-1, the cylinder 70 is actuated to extend the cylinder rod 69, and the sprockets 65, 63 are rotated in a counterclockwise direction to similarly rotate the shaft 61 and the cams 71, 77. The cams are rotated to their positions of FIGS. 3 and 4, respectively, and the electrode 15 is released from the upper arm 21 and is clamped to the lower arm 22 by the positioning of the clamping elements 43 as illustrated in FIG. 1.

The normal operation of the apparatus is then resumed with the arm 22 being vertically actuated to maintain the constant arc at the lower tip of the electrode and the compensate for consumption of the electrode 15.

In the device as actually constructed, the actuation of the motor 80 to raise and lower the lower arm 22 and the actuation of the cylinder 70 to control the releasing and clamping of the electrode to one or the other of the arms 21, 22 is carried out in a microprocessor by well-known, conventional type, and this microprocessor forms no part of the present invention. The microprocessor is simply programmed to carry out the operation of the device as above explained.

We claim:

1. An electrode support for an arc-type furnace comprising a vertical support post, a first support arm fixed to the post and cantilevered therefrom, a second support arm vertically movable along the post and cantilevered therefrom, each arm having clamping means at its free end and the clamping means being aligned for engagement with vertically spaced portions of an electrode extending therebetween, means for vertically adjusting said second arm along said post relative to said fixed first arm, and means for alternately engaging said clamping means with the electrode, said last named means including a vertical shaft pivotable about is vertical axis, power means for pivoting said shaft about its axis, a pair of cams on said shaft aligned with said first arm and said second arm, respectively, and cam follower linkage means carried by said arms, respectively, and engaging the respective cam to actuate said clamping means, the two cams being relatively rotationally offset to alternately engage said clamping means with said electrode, and the electrode being supported by the clamping means for the first arm when the clamping means of the second arm is disengaged therefrom, and vice-versa.

2. An electrode support as defined in claim 1, further characterized by the cam aligned with said second arm being axially slidable along said vertical shaft to accommodate vertical movement of said second support arm.

3. An electrode support for an arc-type furnace comprising a vertical support post, a pair of horizontal arms cantilevered from said post, one of said arms being fixed to the post and the other said arm being movable vertically relative to the post, an electrode-engaging clamp at the free end of each of the arms, the two clamps being vertically aligned to receive the electrode therethrough, and means for engaging and releasing the clamps in sequence including a vertical shaft carried by the upper arm and depending therefrom to a distance at least as great as the extent of vertical movement of the lower arm, means for pivoting said shaft about is vertical axis, cam-actuated means on said first arm for engaging and releasing the first arm clamp upon pivotal movement of the shaft, cam means on the lower arm for engaging and releasing the lower arm clamp upon pivotal movement of said shaft, a pair of cams on said shaft which are pivotal with the shaft to actuate said cam-actuated means, respectively, the cams being rotationally offset from one another on said shaft to engage one clamp while releasing the other clamp, and means accommodating movement of the lower arm cam axially relative to the shaft as the lower arm is moved vertically.

4. An electrode support for an arc-type furnace comprising a vertical support post, a first support arm fixed to the post and cantilevered therefrom, a second support arm vertically movable along the post and cantilevered therefrom, means for vertically adjusting said second arm along the post relative to the fixed first arm, electrode clamping means at the free end of each of said arms, each clamping means including (1) a clamping block fixed to the arm, (2) a slidable clamping element movable relative to the arm, and (3) cam means for sliding said element relative to the arm into and out of clamping relation with said fixed block, a vertical shaft fixed to said fixed first arm and projecting through the movable second arm, said cam means being co-rotatable with said shaft, means for pivoting said shaft about its vertical axis to correspondingly pivot said cam means and means accommodating relative axial movement between the shaft and the cam means of the second support arm as said second arm is moved vertically.

5. An electrode support for an arc-type furnace comprising a vertical support element, a first support arm fixed to the support element, a second support arm vertically movable along the support element, each arm having clamping means which are vertically aligned for engagement with vertically spaced portions of an electrode extending therebetween, means for vertically adjusting said second arm along said support element relative to said fixed first arm, and means for alternately engaging said clamping means with the electrode, said last named means including a vertical camshaft, means for turning said camshaft, two cam means on said shaft for actuating said clamping means, respectively, when said camshaft is turned, the two means being relatively rotationally offset to alternately engage said clamping means with said electrode, and the electrode being supported by the clamping means for the first arm when the clamping means of the second arm is disengaged therefrom, and vice-versa.

* * * * *